US009581011B2

(12) United States Patent
Tjhang

(10) Patent No.: US 9,581,011 B2
(45) Date of Patent: Feb. 28, 2017

(54) DOWNHOLE IMAGING SYSTEMS AND METHODS

(71) Applicant: Schlumberger Technology Corporation, Sugar Land, TX (US)

(72) Inventor: Theodorus Tjhang, Sagamihara (JP)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 677 days.

(21) Appl. No.: 13/935,492

(22) Filed: Jul. 4, 2013

(65) Prior Publication Data

US 2015/0007983 A1 Jan. 8, 2015

(51) Int. Cl.

| | |
|---|---|
| ***E21B 47/00*** | (2012.01) |
| ***E21B 10/60*** | (2006.01) |
| ***E21B 21/00*** | (2006.01) |

(52) U.S. Cl.

CPC ..... *E21B 47/0002* (2013.01); *E21B 10/60* (2013.01); *E21B 21/00* (2013.01)

(58) Field of Classification Search

CPC ..... E21B 47/0002; E21B 23/002

See application file for complete search history.

(56) References Cited

U.S. PATENT DOCUMENTS 3,186,481 A * 6/1965 Foster ..... E21B 47/0002 166/250.1
3,596,582 A * 8/1971 Sayer ..... G03B 37/005 396/19
5,717,455 A * 2/1998 Kamewada ..... G02B 23/2415 348/85
6,041,860 A * 3/2000 Nazzal ..... E21B 23/002 166/250.01
6,424,377 B1 * 7/2002 Driscoll, Jr. ..... G02B 13/06 348/207.99

(Continued)

OTHER PUBLICATIONS

Masatoshi Ishikawa et al., "A CMOS Vision Chip with SIMD Processing Element Array for 1ms Image Processing," IEEE International Solid-State Circuits Conference (ISSCC 1999), Dig. Tech. Papers, pp. 206-207, 1999.

(Continued)

*Primary Examiner* — David Andrews
*Assistant Examiner* — Ronald Runyan
(74) *Attorney, Agent, or Firm* — Trevor G. Grove

(57) ABSTRACT

Downhole Camera systems and methods. Certain systems include a high-speed video camera configured with a 360 degree optical field-of-view, a jet-flushing system capable of temporarily displacing debris substantially simultaneously along all azimuths within the optical field-of-view, and optionally a downhole real-time image processing system for reducing the amount of captured video transmitted to surface. Certain methods include capturing a set of images downhole using a high-speed video camera having a 360 degree optical field-of-view, substantially simultaneously temporarily displacing debris in the optical field-of-view for at least a portion of the time the camera is capturing video using a jet-flushing system capable of projecting flushing fluid substantially simultaneously along all azimuths in the borehole. The methods may also involve pre-processing the set of images to reduce the number of images or reduce the amount of information transmitted to surface.

17 Claims, 19 Drawing Sheets

(56) References Cited

U.S. PATENT DOCUMENTS

| | | | |
|---|---|---|---|
| 7,114,562 | B2 | 10/2006 | Fisseler et al. |
| 2002/0189806 | A1 | 12/2002 | Davidson et al. |
| 2009/0166035 | A1 | 7/2009 | Almaguer |
| 2012/0076364 | A1 | 3/2012 | Tjhang et al. |
| 2012/0127830 | A1 | 5/2012 | Desai |
| 2012/0169841 | A1 | 7/2012 | Chemali et al. |
| 2012/0312530 | A1 | 12/2012 | Pope et al. |

OTHER PUBLICATIONS

International search report and written opinion for the equivalent PCT patent application No. PCT/US2014/045342 issued on Oct. 24, 2014.

* cited by examiner

AREA ISOLATION WITH PACKER

DOWNHOLE CAMERA MODULE ON BEND-SUB

DOWNHOLE IMAGING SYSTEMS AND METHODS

FIELD OF THE DISCLOSURE

This disclosure relates to downhole imaging systems and methods. This disclosure also relates to downhole high-speed imaging systems and methods.

BACKGROUND

Downhole camera services may be used, for example, to diagnose mechanical problems in wells, for example casing and tubing anomalies, and corrosion, or for example for multilateral window identification and observation of items lost in a well (fishing operation). However, existing downhole camera tools are generally incompatible with other logging tools because they usually use their own telemetry system which requires large bandwidth in order to send optical still images or optical moving images (movies). In addition, they may produce unclear or ambiguous images due to the poor visibility of downhole fluid. The poor visibility can be due to the opacity of the downhole fluid (such as dark oil, mud or other opaque downhole fluid), drilling debris, and/or particles inside the downhole fluid. In conventional downhole camera systems, replacing well fluid with clean fluid from surface is one of the methods used to improve the visibility downhole, but it takes costly time from well operations.

SUMMARY

The present disclosure relates to Downhole Camera systems and methods for capturing images downhole, including "smart" Downhole Camera systems and methods involving high-speed downhole processing of captured images. In some embodiments, the Downhole Camera systems include a camera system, for example with a substantially 360 degree optical field-of-view (sideview, downview or both), a jet-flushing system for cleaning the optical field-of-view between the camera and the target, and in the case of smart Downhole Camera systems, a downhole high-speed image processing system. In some embodiments, the methods include positioning the camera system to capture images of the target and synchronizing image capture with illumination of the target and the jet-flushing.

In some embodiments, the Downhole Camera systems and methods are compatible with oilfield tools, such as wireline tools or logging-while-drilling drill strings, coiled tubing tools or other oilfield tools with either pumping ability from surface or which have or may be modified to have compartments to store clear fluid downhole along with an ability to pump clear fluid (water, nitrogen or $CO_2$ or other clear fluid) out of the downhole housing into the annulus. Accordingly, as will be evident to a person of skill reading this disclosure, in some embodiments, the Downhole Camera systems and methods do not require replacing the whole well fluid but only replacing fluid at limited area nearby the fluid exit/nozzle (for example, clear fluid may be pumped from surface at high pressure to create jet-flushing at downhole nozzle exit, this clear fluid jet-flushing will then push away opaque fluid between target and downhole camera windows, wash target surface, wash optical window surface). Hence the downhole fluid in that limited area (target surface, space between target and camera and camera surface) can be cleaned in a relatively short time and using a relatively small amount of clean fluid volume.

In some embodiments, the Downhole Camera systems and methods are compatible with live or real-time imaging while pumping. In some embodiments, when using large bandwidth telemetry such as but not limited to optical fiber telemetry, live/real-time video (movie) data can be sent to surface while pumping. In some embodiments, when using small bandwidth telemetry such as when the Downhole Camera system is used in combination with a coiled tubing Pressure, Temperature, Casing Collar Locator ("PTC") tool, live processed vector data or processed still image data can be sent in real-time. In some embodiments, the Downhole Camera systems and methods according to this disclosure are compatible with logging tools, do not require replacing the whole well fluid, and/or are compatible with live or real-time imaging while pumping.

In some embodiments, Downhole Camera systems include an imaging assembly which includes an imaging system such as camera or video camera having an optical field-of-view, which is suitable for capturing images downhole, and a jet-flushing system configured to jet-flush fluid downhole along all azimuths substantially simultaneously and in the optical field-of-view. In further embodiments, the video camera has a 360 degree optical field-of-view. In some embodiments, the Downhole Camera systems are capable of downview and sideview and the jet-flushing system is capable of cleaning both downview and sideview optical fields-of-view.

In some embodiments, the systems further include an electronics subsystem for controlling the imaging system (e.g., the video camera), for controlling the jet-flushing system, for processing images captured by the video camera, for controlling an illumination/lighting device or combinations thereof, and/or for synchronizing one or more of jet-flushing, illumination and image capture.

In some embodiments, image capture results in a set of captured image frames, and the electronics subsystem includes a processor and a memory containing instructions for execution by the processor, the instructions, if executed by the processor result in substantially synchronizing image capture with jet flushing, applying an image processing algorithm to reduce the number of captured image frames sent to surface, or to reduce the amount of data sent to surface, or combinations thereof. In some embodiments, the image processing algorithm is a massively pixel parallel image processing architecture having a plurality of processing elements, where each processing element is associated with a photo detector and each processing element has an arithemetical logic unit and an internal memory for processing image data captured by its associated photo detector and four neighboring processing elements (up, down, left, right). In further embodiments, the algorithm is an edge-map algorithm that results in identifying a subset of the captured image frames which are clearer than other image frames in the set of captured image frames (for example the identified frames have a higher spatial frequency content than the other frames).

In other embodiments, the jet-flushing system includes a number of nozzles sufficient to project flushing fluid along all azimuths, a number of nozzle orientation controllers sufficient to control the orientation of each nozzle, a number of valves and valve controllers sufficient to control duration of the flow of fluid through each nozzle. In yet other embodiments, the imaging assembly is similar to that described in U.S. patent application Ser. No. 13/439,824, which is herein incorporated by reference in its entirety, but which is modified to utilize a downhole camera (e.g. downhole video camera) having a 360 optical field-of-view and a jet-flushing system capable of projecting flushing fluid substantially simultaneously along all azimuths within the borehole and for example within the optical field-of-view.

In some embodiments, the Downhole Camera methods involve capturing a set of image frames downhole using a video camera having a 360 degree optical field-of-view and substantially simultaneously projecting a flushing fluid downhole using a jet-flushing system configured to project flushing fluid along all azimuths, for example within the optical field-of-view. In further embodiments, the methods involve processing the images downhole to reduce the set of images frames prior to transmission to the surface, for example by using an edge-map algorithm for identifying a subset of images in the set of captured images that is clearer than the other captured images in the set, or that meets a desired threshold level of clarity. In some embodiments, capturing images is performed by a high-speed downhole video camera and images are captured at about 100-1000 frames/second. In some embodiments, the frame rate is defined as the rate where the system can capture enough clear images (more clear images may improve image quality and correspond to a simplified detecting algorithm) during the jet-flushing sequence. In some embodiments, higher frame rates are desirable because they should result in more images captured for a given jet-flushing time and more captured clear images. In some embodiments, the frame rate is determined according to the time required to flush away opaque fluid and replace that fluid with clear fluid at downhole condition using jet-flushing. In some embodiments, the high-speed video camera is configured to provide a 360 degree end view within a borehole, a 360 degree side view within a borehole, or both. In some embodiments, the jet-flushing system is according to any of the embodiments described herein.

The identified embodiments are exemplary only and are therefore non-limiting. The details of one or more non-limiting embodiments of the invention are set forth in the accompanying drawings and the descriptions below. Other embodiments of the invention should be apparent to those of ordinary skill in the art after consideration of the present disclosure.

BRIEF DESCRIPTION OF THE DRAWINGS

Non-limiting example downhole imaging methods and systems are described with reference to the following figures. Where possible, the same numbers are used throughout the figures to reference like features and components.

DETAILED DESCRIPTION

Figure 1A:
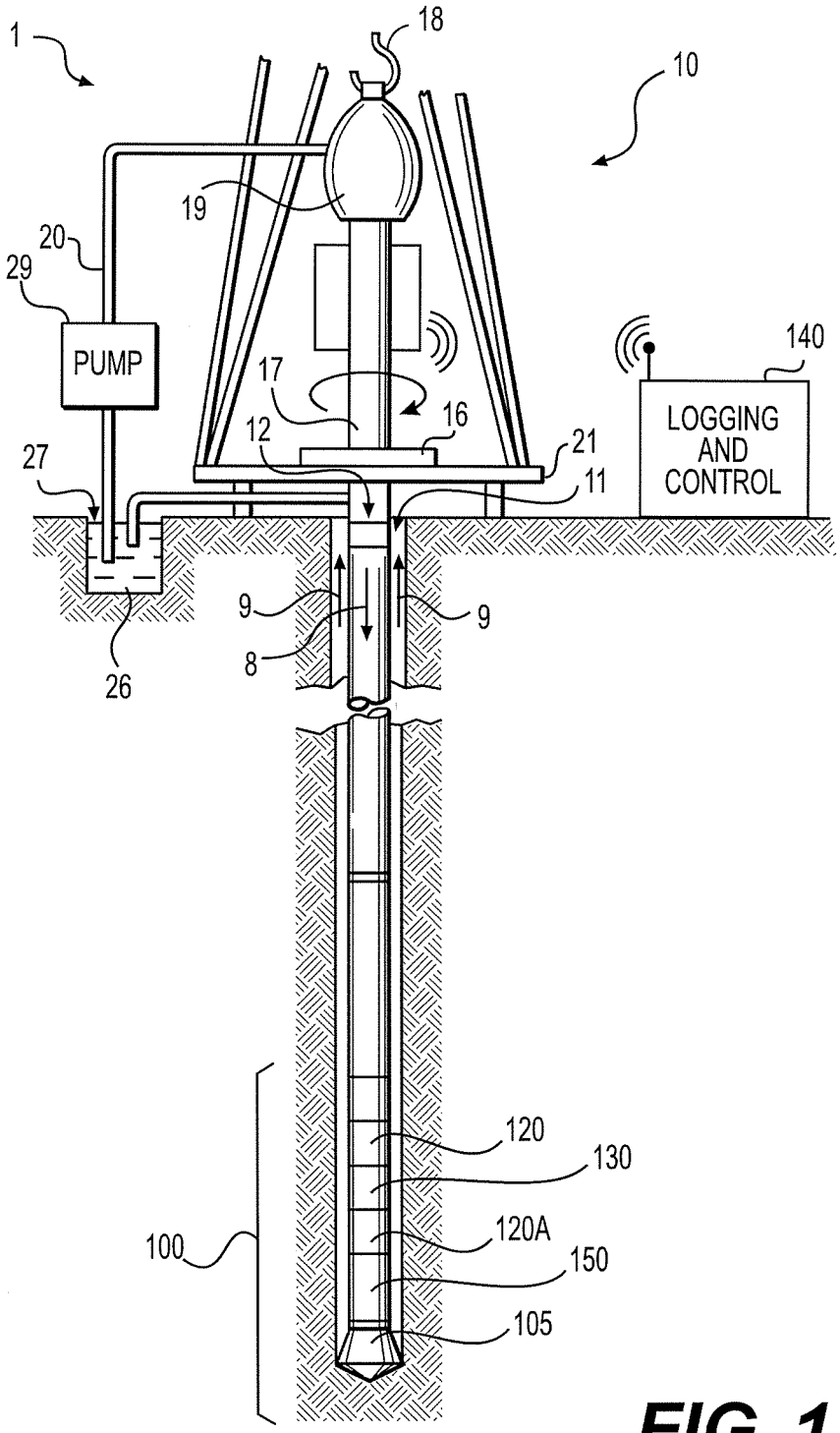
FIG. 1A is a schematic illustrating an embodiment of a wellsite system in which Downhole Camera systems and methods according to this disclosure may be implemented.

In the following detailed description, reference is made to the accompanying drawings, which form a part hereof, and within which are shown by way of illustration certain embodiments by which the subject matter of this disclosure may be practiced. It is to be understood that other embodiments may be utilized and structural changes may be made without departing from the scope of the disclosure. In other words, illustrative embodiments and aspects are described below. But it will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such development effort might be complex and time-consuming, but would nevertheless be a routine undertaking for those of ordinary skill in the art having the benefit of this disclosure.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Where ever the phrases "for example," "such as," "including" and the like are used herein, the phrase "and without limitation" is understood to follow unless explicitly stated otherwise.

The terms "comprising" and "including" and "involving" (and similarly "comprises" and "includes" and "involves") are used interchangeably and mean the same thing. Specifically, each of the terms is defined consistent with the common United States patent law definition of "comprising" and is therefore interpreted to be an open term meaning "at least the following" and is also interpreted not to exclude additional features, limitations, aspects, etc.

The term "about" is meant to account for variations due to experimental error. All measurements or numbers are implicitly understood to be modified by the word about, even if the measurement or number is not explicitly modified by the word about.

The term "substantially" (or alternatively "effectively") is meant to permit deviations from the descriptive term that don't negatively impact the intended purpose. Descriptive terms are implicitly understood to be modified by the word substantially, even if the term is not explicitly modified by the word substantially.

"Measurement While Drilling" ("MWD") can refer to devices for measuring downhole conditions including the movement and location of the drilling assembly contemporaneously with the drilling of the well. "Logging While Drilling" ("LWD") can refer to devices concentrating more on the measurement of formation parameters. While distinctions may exist between these terms, they are also often used interchangeably. For purposes of this disclosure MWD and LWD are used interchangeably and have the same meaning. That is, both terms are understood as related to the collection of downhole information generally, to include, for example, both the collection of information relating to the movement and position of the drilling assembly and the collection of formation parameters.

The present disclosure relates to Downhole Camera systems and methods for capturing images downhole using jet-flushing equipment and techniques. The present disclosure also relates to "smart" Downhole Camera systems and methods, which can process images downhole, for example which have on-board pixel parallel image processing ability to process images captured downhole. In some embodiments, the ability to do such high-speed image processing downhole enables the systems and methods to create and/or detect high-quality images such as but not limited to: detecting one or more clear image frames out of a set of captured image frames during a jet-flushing sequence (see, e.g., FIG. 16); performing image reconstruction to improve image quality; or detecting the dimension of the target (size, shape, etc.) In other words, in some embodiments, instead of large-size movie data, the processed data can be one or more high-quality still pictures or can be in the format of vector data (shape information, dimension information, coordinate information, etc.)

In some embodiments, processing images downhole can result in small-size processed data, which can then be sent to surface using existing oilfield telemetry systems such as but not limited to coiled tubing telemetry tool (PTC, etc.) with relatively small bandwidth. In some embodiments, the Downhole Camera systems and methods are compatible with oilfield tubing as described in connection with FIGS. 1*a*, 1*b* and 2 below, or even other oilfield tools such as those with pumping ability from surface or oilfield tools which have or may be configured to have compartments to store clear fluid downhole and the ability to pump the clear fluid (water, nitrogen or CO2 or other clear fluid) out of the tool housing into the annulus.

In some embodiments, the Downhole Camera systems and methods are compatible with live or real-time imaging while pumping. When using large bandwidth telemetry such as but not limited optical fiber telemetry, a live/real-time video (movie) data can be sent to surface while pumping. When using small bandwidth telemetry such as in combination with existing telemetry tools such as but not limited to coiled tubing PTC tool, live processed vector data or processed still image data can be sent in real-time.

Turning to the figures, FIG. 1A illustrates an embodiment of a wellsite system 1 in which Downhole Camera methods and systems disclosed herein can be employed. The wellsite can be onshore or offshore. In the illustrated system, a borehole 11 is formed in subsurface formations by rotary drilling, however other drilling systems can be used with the Downhole Camera systems and methods of this disclosure, such as directional drilling systems.

A drillstring 12 is suspended within the borehole 11 and has a bottom hole assembly 100 that includes a drill bit 105 at its lower end. The surface system includes platform and derrick assembly 10 positioned over the borehole 11, the assembly 10 including a rotary table 16, kelly 17, hook 18 and rotary swivel 19. In an example, the drill string 12 is suspended from a lifting gear (not shown) via the hook 18, with the lifting gear being coupled to a mast (not shown) rising above the surface. An example lifting gear includes a crown block whose axis is affixed to the top of the mast, a vertically traveling block to which the hook 18 is attached, and a cable passing through the crown block and the vertically traveling block. In such an example, one end of the cable is affixed to an anchor point, whereas the other end is affixed to a winch to raise and lower the hook 18 and the drillstring 12 coupled thereto. The drillstring 12 is formed of drill pipes screwed one to another.

The drillstring 12 may be raised and lowered by turning the lifting gear with the winch. In some scenarios, drill pipe raising and lowering operations require the drillstring 12 to be unhooked temporarily from the lifting gear. In such scenarios, the drillstring 12 can be supported by blocking it with wedges in a conical recess of the rotary table 16, which is mounted on a platform 21 through which the drillstring 12 passes.

In the illustrated example, the drillstring 12 is rotated by the rotary table 16, energized by means not shown, which engages the kelly 17 at the upper end of the drillstring 12. The drillstring 12 is suspended from the hook 18, attached to a traveling block (also not shown), through the kelly 17 and the rotary swivel 19, which permits rotation of the drillstring 12 relative to the hook 18. In some examples, a top drive system could be used.

In the illustrated example, the surface system further includes drilling fluid or mud 26 stored in a pit 27 formed at the wellsite. A pump 29 delivers the drilling fluid 26 to the interior of the drillstring 12 via a hose 20 coupled to a port in the swivel 19, causing the drilling fluid to flow downwardly through the drillstring 12 as indicated by the directional arrow 8. The drilling fluid exits the drillstring 12 via ports in the drill bit 105, and then circulates upwardly through the annulus region between the outside of the drillstring and the wall of the borehole, as indicated by the directional arrows 9. In this manner, the drilling fluid lubricates the drill bit 105 and carries formation cuttings up to the surface as it is returned to the pit 27 for recirculation.

The bottom hole assembly 100 includes one or more specially-made drill collars near the drill bit 105. Each such drill collar has one or more logging devices mounted on or in it, thereby allowing downhole drilling conditions and/or various characteristic properties of the geological formation (e.g., such as layers of rock or other material) intersected by the borehole 11 to be measured as the borehole 11 is deepened. In particular, the bottom hole assembly 100 of the illustrated example system 1 includes a logging-while-drilling (LWD) module 120, a measuring-while-drilling (MWD) module 130, a roto-steerable system and motor 150, and the drill bit 105.

The LWD module 120 is housed in a drill collar and can contain one or a plurality of logging tools. It will also be understood that more than one LWD and/or MWD module can be employed, e.g., as represented at 120A. (References, throughout, to a module at the position of 120 can mean a module at the position of 120A as well.) The LWD module 120 may include capabilities for measuring, processing, and storing information, as well as for communicating with the surface equipment.

The MWD module 130 is also housed in a drill collar and may contain one or more devices for measuring characteristics of the drillstring 12 and drill bit 105. The MWD module 130 may further include an apparatus (not shown) for generating electrical power to the downhole system. This may include a mud turbine generator powered by the flow of the drilling fluid, it being understood that other power and/or battery systems may be employed. In the illustrated example, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

The wellsite system 1 also includes a logging and control unit 140 communicably coupled in any appropriate manner to the LWD module 120/120A and the MWD module 130. In the illustrated example, the LWD module 120/120A and/or the MWD module 130, in conjunction with the logging and control unit 140, collectively implement certain embodiments of systems and methods consistent with this disclosure. For example, the LWD module 120/120A and/or the MWD module 130 may include an imaging assembly and a flushing assembly associated with the imaging assembly to improve the quality of images relative to images captured using a video camera alone. Acquired images may be pre-processed downhole, for example by an image processor associated with the downhole imaging system, prior to transmission to surface. Although embodiments disclosed herein are described in the context of LWD and MWD applications, they are not limited thereto. Instead, for example, they may also be used in other applications, such as wireline logging, production logging, permanent logging, fluid analysis, formation evaluation, sampling-while-drilling, etc.

Figure 1B:
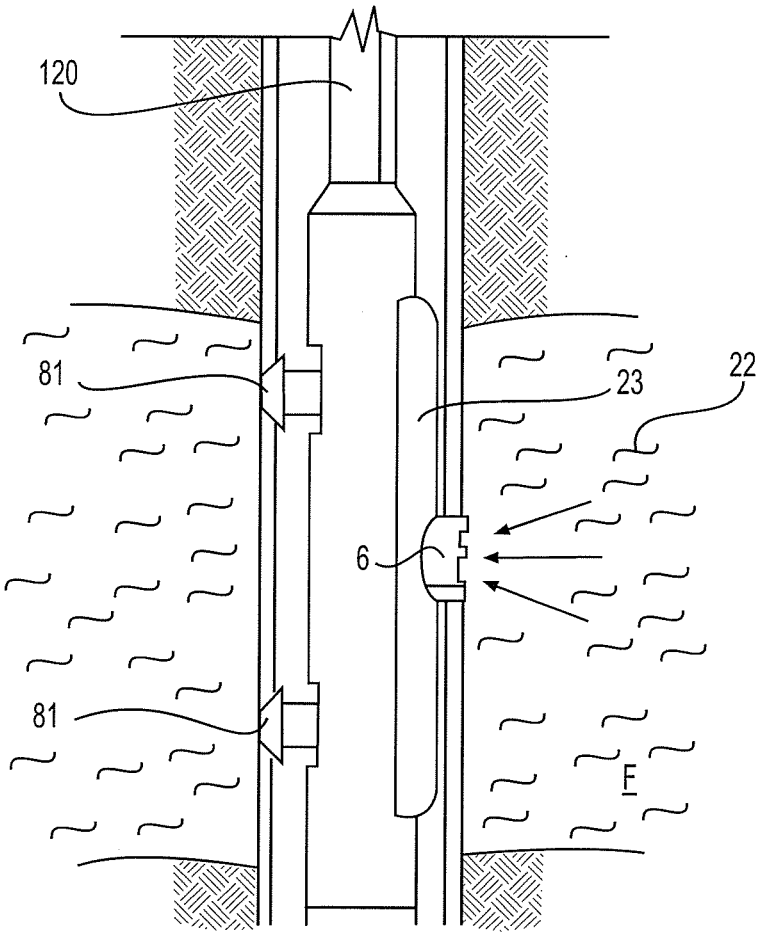
FIG. 1B is a schematic illustrating an embodiment of a sampling-while-drilling logging device capable of supporting a downhole camera module at downhole environments as disclosed herein.

For example, FIG. 1B is a simplified diagram of an example sampling-while-drilling logging device of a type described in U.S. Pat. No. 7,114,562, incorporated herein by reference in its entirety, which can be used as the LWD tool 120 or part of an LWD tool suite 120A, and in which systems and methods disclosed herein can be used. The LWD tool 120 is provided with a probe 6 for establishing fluid communication with the formation and drawing the fluid 22 into the tool, as indicated by the arrows. The probe may be positioned in a stabilizer blade 23 of the LWD tool and extended therefrom to engage the borehole wall. The stabilizer blade 23 comprises one or more blades that are in contact with the borehole wall. Fluid drawn into the tool using the probe 6 may be measured to determine, for example, pretest and/or pressure parameters. Additionally, the LWD tool 120 may be provided with devices, such as sample chambers, for collecting fluid samples for retrieval at the surface. Backup pistons 81 may also be provided to assist in applying force to push the tool and/or probe against the borehole wall.

Figure 2:
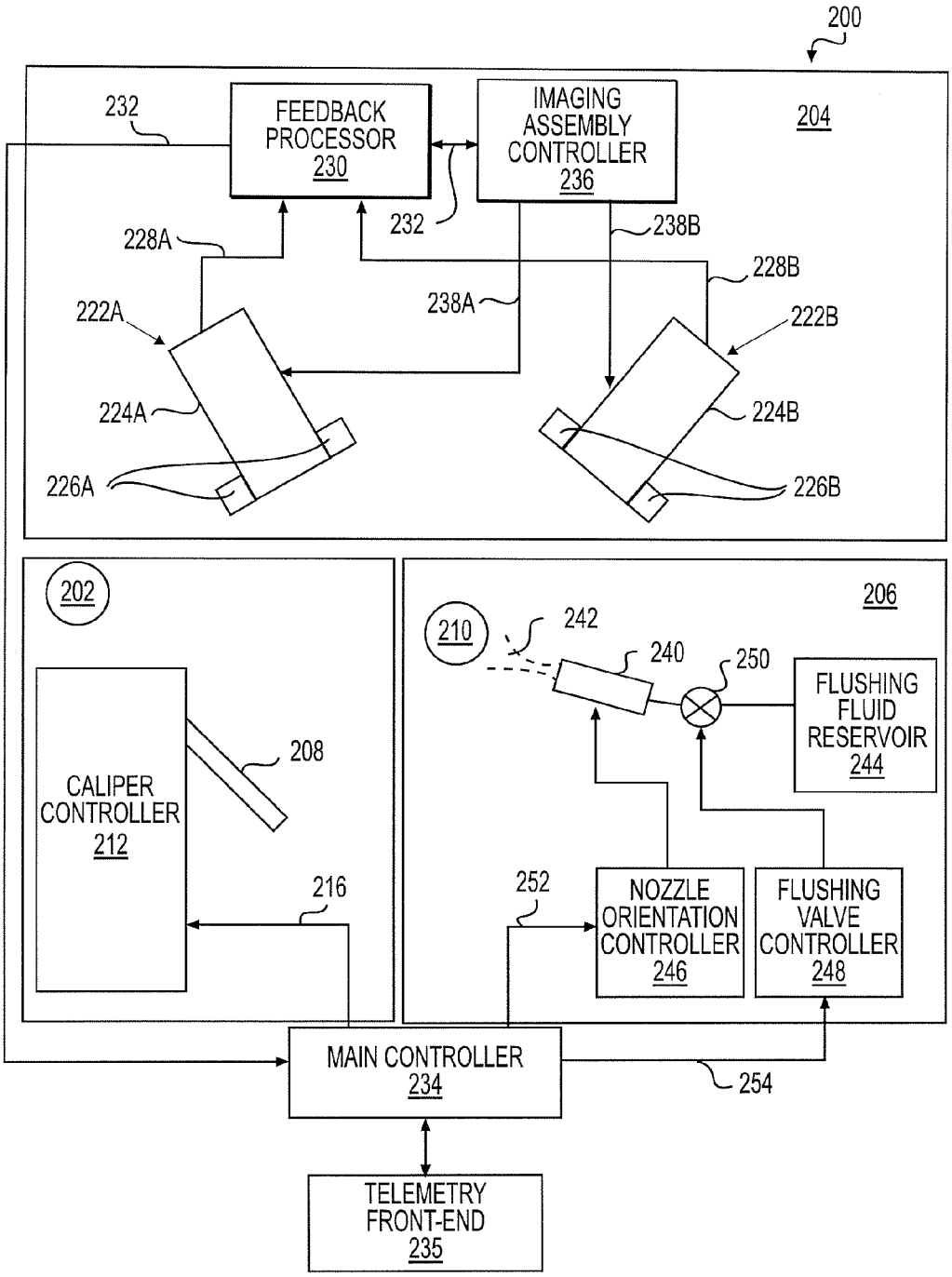
FIG. 2 is a block diagram illustrating an embodiment of a Downhole Camera system, which may be adapted for use as a Downhole Camera system in accordance with this disclosure for example by utilizing a video camera with a 360 degree optical field-of-view in the imaging system and modifying the illustrated jet-flushing system to include sufficient nozzles to provide 360 degree coverage consistent with the optical field-of-view.

FIG. 2 illustrates an example imaging-based remote control system 200 for controlling equipment in the example wellsite system 1 of FIG. 1A, the example sampling-while-drilling logging device of FIG. 1B and/or for use in controlling equipment in other remote environments. The imaging-based remote control system 200 of the illustrated example includes an example manipulator assembly 202, an example flushing assembly 206, and an example imaging assembly 204 which may be adapted for use with the Downhole Camera systems in accordance with this disclosure. The manipulator assembly 202 includes an example manipulator, such as a caliper 208 which may be used as further described below. The manipulator assembly 202 of the illustrated example also includes an example manipulation controller 212 operatively coupled to the manipulator 208 based on a control signal derived from an externally-applied control input 216. In some examples, the manipulation controller 212 derives the control signal for controlling manipulator 208 using any appropriate combination of the externally-applied control input 216 and local sensor feedback obtained from one or more example sensors, such as tactile sensors, contact sensors, etc.

As mentioned above, FIG. 2 illustrates an imaging assembly 204 which may be adapted for use with Downhole Camera systems in accordance with this disclosure. The illustrated imaging assembly 204 includes two (or more) example imaging systems 222A-B. The imaging systems 222A-B include respective example imaging devices 224A-B and example light sources 226A-B to generate respective example imaging measurement signals 228A-B to be provided to an example feedback processor 230. The imaging devices 224A-B can be implemented by one or more positionable (e.g., movable, adjustable, rotatable, etc.) cameras, one or more positionable imaging sensors, one or more imaging processors. In the illustrated example, the feedback processor 230 processes the measurement signals 228A-B to determine one or more example feedback signals 232 for use in controlling the imaging assembly 204 and the flushing assembly 206. In some embodiments, Downhole Camera systems in accordance with this disclosure may include only a single imaging system 222A or B, for example, and consequently only a single imaging device 224A or B, which may be a video camera having a 360 degree optical field-of-view, as further described below. In some embodiments, Downhole Camera systems in accordance with this disclosure may include an additional imaging system (in addition to 222A and B), for example, and consequently an additional imaging device (in addition to 224A and B), which may be a video camera having a 360 degree optical field-of-view, as further described below.

In the system 200 of FIG. 2, the imaging systems 222A-B may be used to determine respective two-dimensional positioning data (e.g., such as location information, boundary information, etc.) for objects, such as object 210, in their respective optical fields-of-view. This two-dimensional positioning data is included in the respective measurement signals 228A-B provided by the imaging systems 222A-B to the feedback processor 230. The feedback processor 230 then combines the two-dimensional positioning data included in the received measurement signals 228A-B using any appropriate techniques to determine three-dimensional positioning data (e.g., such as location information, boundary information, etc.) for the objects, such as the object 210, including in the overlapping fields-of-view of the imaging devices 224A-B. The three-dimensional positioning data is included in the feedback signal(s) 232 output by the feedback processor 230.

In the illustrated example, feedback signal(s) 232 are provided to an example main controller 234 for use in implementing feedback control of the manipulator assembly 202. For example, the three-dimensional positioning data included in the feedback signal(s) 232 can be processed by the main controller 234 using any appropriate feedback control algorithm to produce the externally-applied control input 216 to be applied to the manipulation controller 212 to control the manipulator 208. In some examples, the main controller 234 also reports the three-dimensional positioning data (and/or any other data) included in the feedback signals(s) 232 to a remote receiver on the surface via an example telemetry front-end 235 communicatively coupling the main controller 234 to a telemetry communications link (not shown).

In the illustrated example, the feedback signal(s) 232 may also be provided to an example imaging assembly controller 236 for use in implementing feedback control of the imaging systems 222A-B included in the imaging assembly 204. For example, the three-dimensional positioning data included in the feedback signal(s) 232 can be processed by the imaging assembly controller 236 using any appropriate feedback control algorithms to produce respective control signals 238A-B to control the orientation (e.g., angle, focal length, etc.) of the imaging systems 222A-B. For example, the control signals 238A-B can be used to adjust the optical fields-of-view of the positionable imaging devices 224A-B, thereby enabling images of the target object 210 to be captured at appropriate angles. Additionally or alternatively, the control signals 238A-B can be used to adjust the orientation, intensity, etc. of the positionable light sources 226A-B illuminating the respective fields-of-view of the imaging systems 222A-B.

In the illustrated example system 200, the feedback signal(s) 232 may also be provided to the main controller 234 for use in implementing feedback control of the flushing assembly 206. The illustrated flushing assembly 206 may project flushing fluid for many purposes, such as, but not limited to, cleaning the optical fields-of-view of the imaging systems 222A-B (e.g., which may contain an opaque fluid), cleaning the optics (e.g., windows, lenses, etc.) of the imaging devices 224A-B, cleaning the surface of the object(s) 210, etc. The illustrated flushing assembly 206 of FIG. 2 may be adapted for use with Downhole Camera systems and methods in accordance with this disclosure. For example, whereas the flushing assembly 206 of FIG. 2 includes an example nozzle 240 to project example flushing fluid 242, flushing assemblies suitable for use with Downhole Camera systems and methods of this disclosure may include a sufficient number of nozzles 240 (and related componentry described below) to project flushing fluid 360 degrees around the borehole, for example, within the camera's optical field-of-view (which camera may be a video camera having a substantially 360 degree optical field-of-view). In some examples, the flushing fluid is obtained from an example flushing fluid reservoir 244. The flushing fluid can be, for example, air (e.g., oxygen), nitrogen, water or some other substantially transparent fluid, etc.

In the illustrated example of FIG. 2, the flushing assembly 206 also includes an example nozzle orientation controller 246, an example valve controller 248 and an example valve 250. The nozzle orientation controller 246 of the illustrated example controls the orientation (e.g., direction) of the nozzle 240 to cause the flushing fluid 242 to be projected (e.g., jet flushed) at the object(s) 210 and/or other desired location(s) at the appropriate angle(s) to achieve a desired purpose, for example to temporarily displace opaque fluid such as drilling mud out of the camera's optical field-of-view. As such, in the illustrated example, the main controller 234 processes the three-dimensional positioning data included in the feedback signal(s) 232 using any appropriate feedback control algorithms to produce a control signal 252 to control the nozzle orientation controller 246 and, thus, the nozzle 240 to cause the flushing fluid 242 to be projected to the desired location/direction.

The flushing valve controller 248 of the illustrated example controls the times at which the valve 250 is opened and closed to control times and durations of flushing fluid projection by the nozzle 240. Unlike in prior systems in which the flushing fluid is projected continuously (or substantially continuously), the flushing valve controller 248 and valve 250 enable the flushing fluid 242 to be projected momentarily (e.g., on the order of milliseconds) substantially at times when the imaging systems 222A-B are capturing imaging data for their respective fields-of-view. As such, in some examples, the measurement data 228A-B provided by the imaging systems 222A-B includes timing data indicating times (and durations) corresponding to when the imaging devices 224A-B are to capture respective imaging data corresponding to their respective optical fields-of-view. This timing data can be included in the feedback signal(s) 232 output by the feedback processor 230 and provided to the main controller 234. In such examples, timing data included in the feedback signal(s) 232 can be processed by the main controller 234 using any appropriate feedback control algorithms to produce a control signal 254 to control the flushing valve controller 248 and, thus, cause the valve 250 to permit the flushing fluid 242 to be projected by the nozzle 240 at the appropriate time(s) and for the appropriate duration(s).

Figure 3:
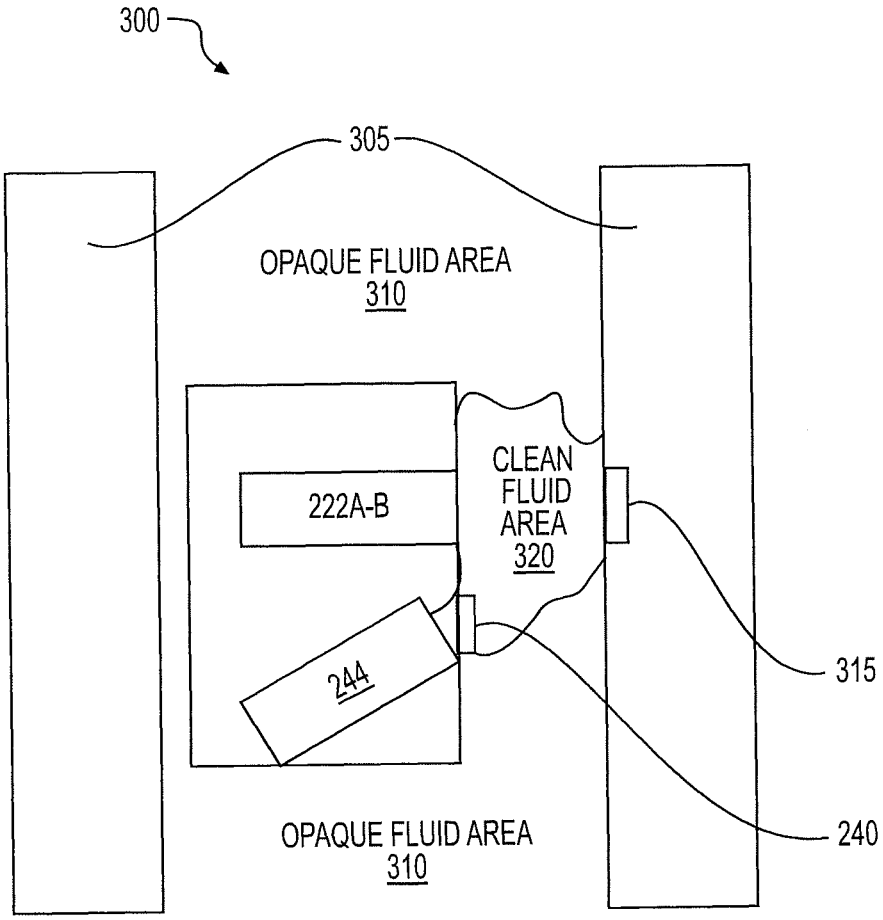
FIG. 3 is a block diagram further illustrating operation of the flushing assembly of FIG. 2, and is exemplary of how a modified Downhole Camera system in accordance with this disclosure may be operated.

FIG. 3 further depicts an example operation 300 of the flushing assembly 206 in the downhole camera module 200 of FIG. 2. In the illustrated example of FIG. 3, portions of the downhole camera module 200, such as the imaging systems 222A-B of the imaging assembly 204, and the nozzle 240 and flushing fluid reservoir 244 of the flushing assembly 206, are located downhole in a borehole of a formation 305. The borehole contains an area of opaque fluid 310, which may include, but is not limited to, drilling fluid/mud, etc.

In the example operation 300, the imaging systems 222A-B are controllably positioned to capture images of an example target 315, which may correspond to the object(s) 210, a drilling cut sample to be examined, an unproductive reservoir region to be shielded, or any other target area of interest. To improve the quality of the images captured by the imaging systems 222A-B, the nozzle 240 of the flushing assembly 206 is controllably positioned to project flushing fluid from the flushing fluid reservoir 244 to yield an example clean fluid area 320 in the optical field-of-view of the imaging systems 222A-B. In some examples, the quality of the images can be improved by controlling the caliper 208 in order to move the downhole camera module closer to the object(s) 210. In some examples, the timing of flushing fluid projection is coordinated to coincide with when the imaging systems 222A-B are to capture images of the target 315, as described above. As further described herein, for example in connection with FIGS. 4-10, Downhole Camera methods according to this disclosure can be modifications of example operation 300 to provide a 360 view within the borehole. For example, the imaging system may include a single 360 video camera, and the flushing assembly, which includes a sufficient number of nozzles to project fluid 360 degrees within the borehole, is controllably positioned to project flushing fluid from a flushing reservoir to yield a 360 degree clean fluid area in the optical field-of-view of the imaging system (e.g., video camera having a 360 degree optical field-of-view).

Although the example systems of FIGS. 2-3 are illustrated as including a flushing fluid reservoir 244 from which the flushing fluid 242 is to be obtained, other techniques for obtaining the flushing fluid 242 can also be employed. For example, the flushing fluid 242 can be pumped to the remote environment via coiled tubing, pumped to the remote environment via a drilling pipe, obtained locally at the remote environment via filtering of at least one of drilling fluid, completion fluid or production fluid, obtained locally at the remote environment via separation of substantially transparent fluid from at least one of drilling fluid, completion fluid or production fluid, etc.

In some examples, the light sources 226A-B of the imaging systems 222A-B can correspond to fluorescent lighting sources. In some examples, the light sources 226A-B can provide stripe or dot pattern illumination. In some examples, the imaging systems 222A-B can support multiple light sources 226A-B with different angles of lighting and/or combinations of penetration-type lighting device(s) and/or reflection-type lighting device(s). In some examples, the imaging systems 222A-B include a light focusing device (e.g., adjustable lens, mirrors, etc.) positioned and controllable by the imaging assembly controller 236 to adjust the light emanating from the light sources 226A-B.

In some examples, the imaging systems 222A-B include one or more focal-adjustable lens to support tracking (e.g., in real-time and/or in multiple dimensions) of one or more objects 210 in the remote environment. For example, the imaging assembly controller 236 can implement an automated control loop using the positioning data included in the feedback signal(s) 232 to adjust such a focal-adjustable lens to track an object 210 in the remote environment. For example, and as described above, each imaging system 222A-B may determine image data for the object 210 and processes the image data to determine two-dimensional object location and boundary information. The feedback processor 230 then uses the determined two-dimensional object location information (e.g., two-dimensional object coordinates) to determine three-dimensional object location information (e.g., three-dimensional object coordinates) that can be used by the imaging assembly controller 236 to adjust a focal length and/or an angle of an adjustable lens to track (e.g., using a feedback control loop) the motion of the object 210 in the remote environment. In some examples, the imaging assembly controller 236 can adjust the adjustable lens based on commands received from the surface via a telemetry communication link (not shown), where the commands can be based on the object location information included in the feedback signals(s) 232 reported by the feedback processor 230 via the telemetry communication link.

In some examples, the imaging assembly 204 (and, in particular, imaging systems 222A-B) can include one or more cooling devices to reduce and/or maintain devices/assembly operating temperature. For example, the imaging systems 222A-B can include thermal electric cooler(s) to reduce the operating temperature(s) of one or more semiconductors and/or other processing devices used to implement the imaging systems 222A-B. In some examples, the imaging systems 222A-B can use other cooling mechanisms based on heat transfer methods, such as using one or more heat-sinks and/or circulating low temperature fluid around the semiconductor(s) and/or other processing devices implementing the imaging systems 222A-B.

Figure 4:
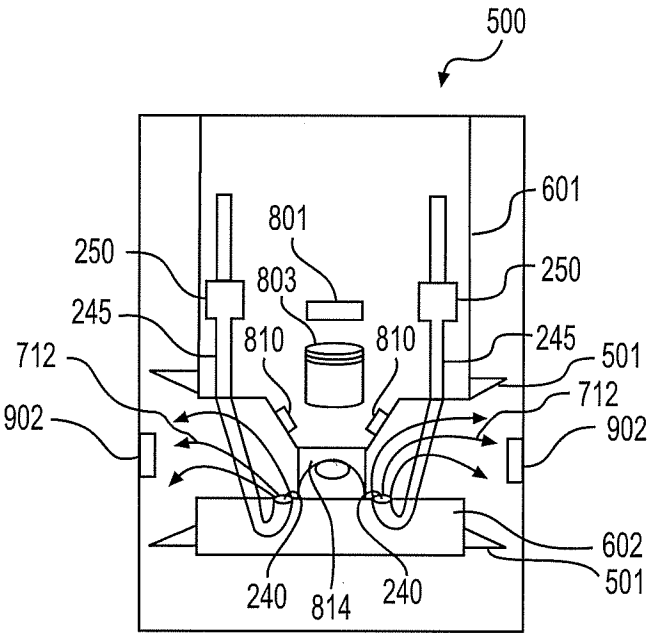
FIG. 4 is a schematic illustrating a Downhole Camera system in accordance with an embodiment of this disclosure, which is configured for use at the bottom of a tool string and to provide a 360 degree sideview of the downhole environment. The embodiment includes a 360 degree camera and jet-flushing system which may be substituted into the Downhole Camera system of FIG. 2.
Figure 5:
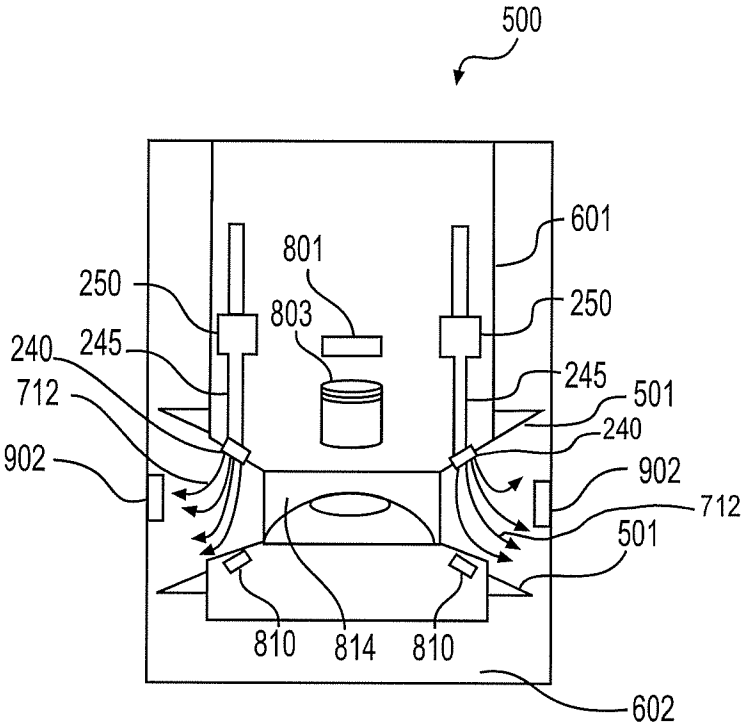
FIG. 5 is a schematic illustration of another embodiment of a Downhole Camera system in accordance with an embodiment of this disclosure, which embodiment is also configured for use at the bottom of a tool string and to provide a 360 degree side view of the downhole environment. Similar to the embodiment of FIG. 4, the embodiment of FIG. 5 includes a 360 degree camera and jet-flushing system which may be substituted into the Downhole Camera system of FIG. 2.
Figure 6:
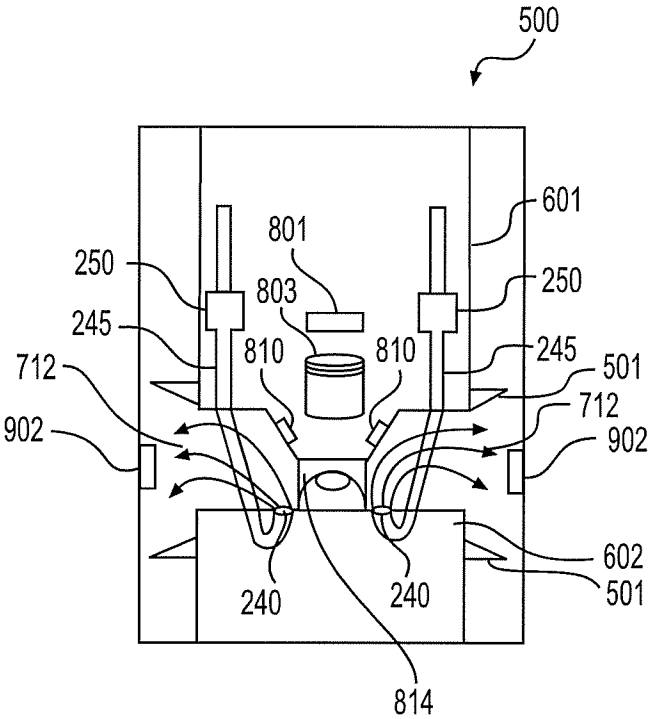
FIG. 6 is a schematic illustration of another embodiment of a Downhole Camera system in accordance with an embodiment of this disclosure, which embodiment is also configured to provide a 360 degree side view of the downhole environment but which is configured for use in the middle of the drillstring. Similar to the embodiment of FIG. 4, the embodiment of FIG. 6 includes a 360 degree camera and jet-flushing system which may be substituted into the Downhole Camera system of FIG. 2.
Figure 7:
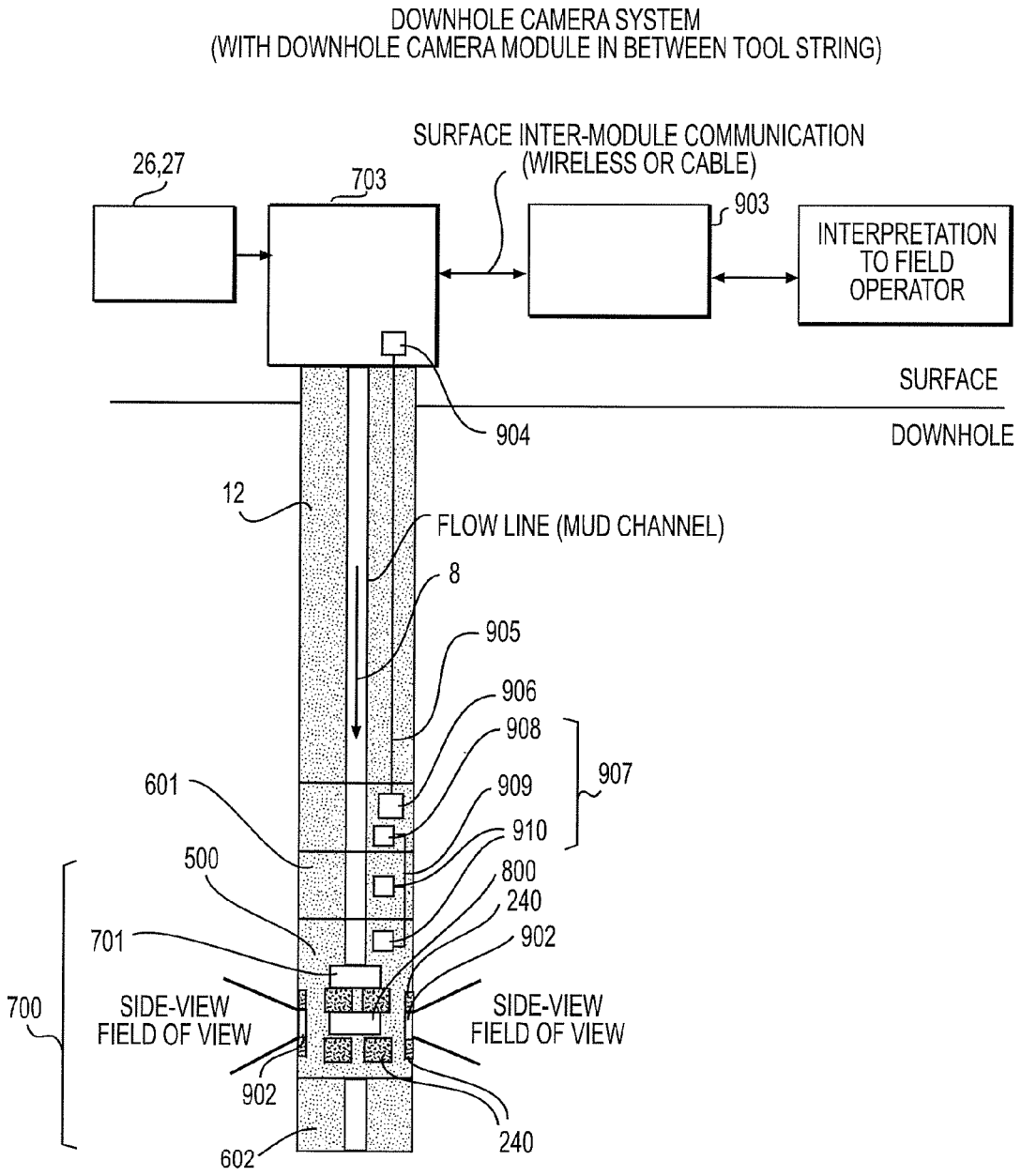
FIG. 7 is a schematic illustration of an embodiment of a Downhole Camera system configured for use in the middle of a drillstring, such as shown in FIG. 6, integrated into a wellsite system, such as shown in FIG. 1.
Figure 8:
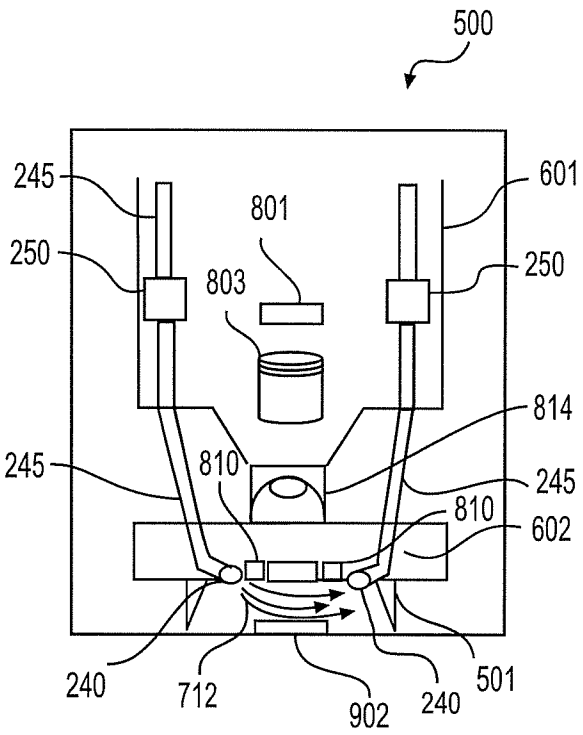
FIG. 8 is a schematic illustration of another embodiment of a Downhole Camera system in accordance with an embodiment of this disclosure, which embodiment is configured to provide a 360 degree downview within the borehole. Similar to the embodiment of FIG. 4, the embodiment of FIG. 8 includes a 360 degree camera and jet-flushing system which may be substituted into the Downhole Camera system of FIG. 2.
Figure 9:
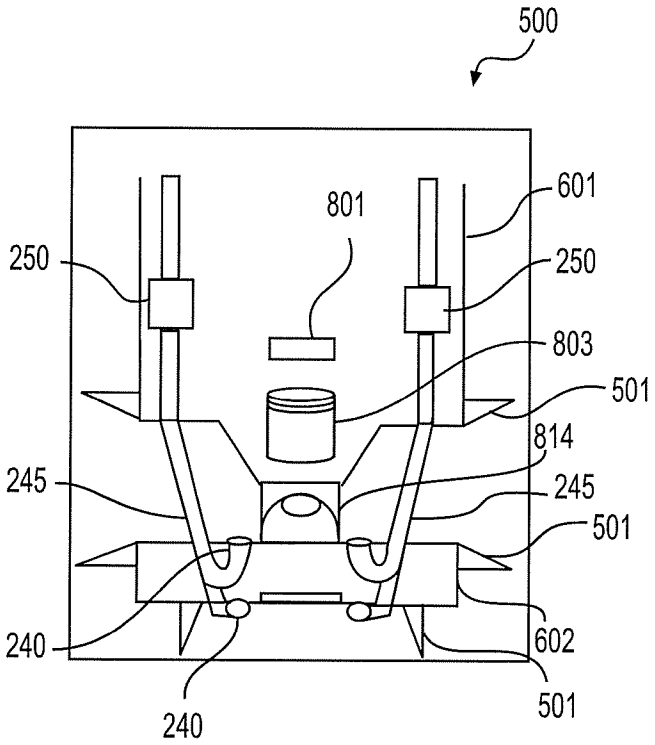
FIG. 9 is a schematic illustration of a further embodiment of a Downhole Camera system in accordance with an embodiment of this disclosure, which embodiment is configured to provide both a 360 degree downview and a 360 degree sideview within the borehole. Similar to the embodiment of FIG. 4, the embodiment of FIG. 9 includes a 360 degree camera and jet-flushing system which may be substituted into the Downhole Camera system of FIG. 2.
Figure 10:
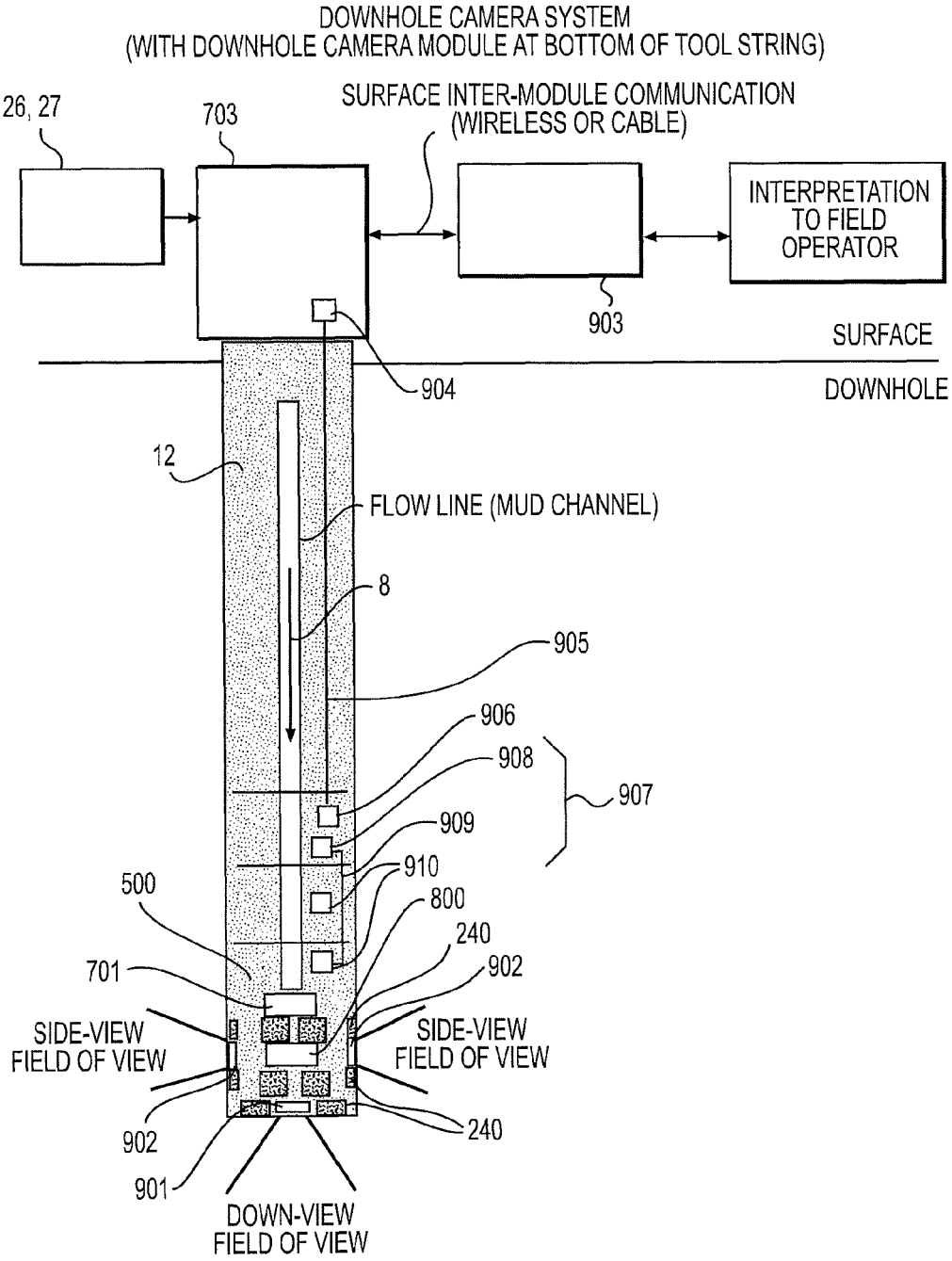
FIG. 10 is a schematic illustration of an embodiment of a Downhole Camera system configured for providing both downview and sideview within the borehole, such as shown in FIG. 9, integrated into a wellsite system, such as shown in FIG. 1.
Figure 12:
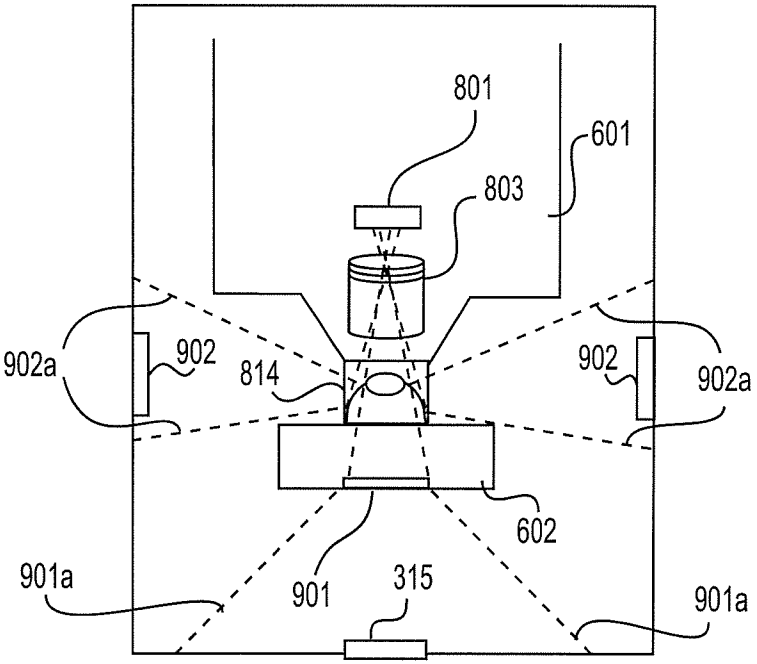
FIG. 12 is a schematic illustration of possible 360 degree optical paths associated with embodiments of video cameras such as shown in FIGS. 4-10 and which are suitable for use in the Downhole Camera systems and methods according to this disclosure.

FIGS. 4-10 illustrate Downhole Camera systems, which comprise modified versions of the imaging systems and jet-flushing systems described in connection with FIG. 2, which result in Downhole Camera systems capable of providing 360 degree views within a borehole. For example, the Downhole Camera systems of FIGS. 4-10 include an imaging system having a 360 degree optical field-of-view and a flushing system configured to project flushing fluid 360 degrees within a borehole, for example within the imaging system's optical field-of-view. More specifically, FIGS. 4 and 5 illustrate Downhole Camera systems configured for use at the bottom of a drillstring and which provides a 360 degree sideview within the borehole. FIGS. 6 and 7 illustrate a Downhole Camera system configured for use in the middle of a drillstring and which also provides a 360 degree sideview within the borehole. FIG. 8 illustrates a Downhole Camera system configured to provide a 360 degree downview within the borehole, and FIGS. 9 and 10 illustrate a Downhole Camera system configured to provide both a 360 degree downview and a 360 degree sideview within the borehole (i.e., a Downhole Camera system where the camera is located at the bottom of the toolstring). FIG. 12 depicts as dashed lines an example of the optical field-of-view that Downhole Camera systems according to this disclosure may permit, including dashed lines representing a 360 degree downview 901*a* (through downview optical windows 901), as well as dashed lines representing a 360 degree sideview 902*a* (through sideview optical windows 902).

Each of FIGS. 4-10 illustrates Downhole Camera system 500, which may be used with a downhole tool, for example as better illustrated in FIGS. 7 and 10. As shown in FIGS. 4-10, an embodiment of a Downhole Camera system 500 comprises a jet-flushing system 700 configured to displace fluid present in a borehole along all azimuths (360 degrees) and an imaging system 800 configured to provide a 360 view for acquiring images in the borehole. At least portions of the Downhole Camera system 500, such as at least portions of the jet-flushing system 700 and imaging system 800, are integrated into upper 601 and bottom 602 parts of the tool chassis.

FIGS. 7 and 10 illustrate embodiments of how a Downhole Camera system 500, such as those shown in FIGS. 4-6, 8 and 9 may be used with a downhole tool. In FIG. 7, the Downhole Camera system 500 is shown integrated in the middle of a tool string 12, whereas in FIG. 10, the Downhole Camera system 500 is shown integrated at the bottom of a tool string 12. The Downhole Camera system 500 includes jet-flushing system 700 shown to include fluid nozzles 240 and a downhole jet-flush controller 701 drawing fluid from the surface 26/27 (fluid storage pit and fluid), which is pumped by a surface pumping and control system 703. The Downhole Camera system 500 also includes an imaging device with integrated processing unit 800, optical windows 902 to provide side view or down view as applicable. The Downhole Camera system 500 may also include fluid guides 501 to prevent or alleviate annulus fluid from flowing into the jet-flushing target area. Also shown are various possible components of a processing and/or telemetry system including a surface telemetry acquisition system 903, surface telemetry front end 904, downhole telemetry line 905, which may be a cable or fiber optics line as examples, telemetry front end 906, and toolbus system 907 including a downhole toolbus controller master 908, downhole tool bus 909, and downhole tool bus controller slave 910.

The imaging systems 500 of FIGS. 4-10 may be comparable to that described in FIG. 2, however in some embodiments, the imaging systems include a video camera configured to enable a 360 degree view of the borehole. In such embodiments, the video camera may be any suitable video camera which may provide a 360 degree view. In further embodiments, the video camera is also a high-speed video camera, for example, capable of shooting video at a rate of about 100-1000 frames/second. In some embodiments, a desired frame rate is determined by and correlated to the jet-flushing time required to flush away opaque fluid and replace such fluid with clear fluid at downhole conditions. Generally, the shorter the jet-flush, the higher the desired frame rate. Generally, without wishing to be bound by theory, higher frame rate results in more images captured and hence the possibility of capturing clearer images. More clear images can improve imaging quality for example but not limited by using image combining techniques, which can generate a high-quality image from multiple available images. A greater number of clear images may also make the "Clear Image Detection" algorithm (for example an edge-map detection algorithm as described below) simpler.

As shown in FIGS. 4-10, the imaging systems 500 comprise, for example, lighting devices 810, a lens 803, a focal adjustment device 801, and a hemispheric mirror 814 for reflecting a 360 degree image back to the lens. The hemispheric mirror 814 may be incorporated onto a fused silica block. The imaging system 500 may also comprise additional components, such as for example components described in connection with the imaging system of the embodiment of FIG. 2.

The jet-flushing systems 700 in FIGS. 4-10 include similar elements to the jet-flushing system of FIG. 2, specifically nozzles 240, valves 250, and flowlines 245 (not shown in FIG. 2). Other components of the jet-flushing system of FIG. 2 may also be used in connection with the embodiments of FIGS. 4-10, but for ease of description are not shown. In contrast to the embodiment of FIG. 2, the jet-flushing systems of FIGS. 4-10 include a sufficient number of nozzles 240 to enable projection of flushing fluid in a 360 degree path, for example coinciding with the video camera's 360 degree optical field-of-view. Flowlines 245 connect nozzles 240 to pumping fluid, for example which may be located at the surface, and valves 250 control the flow of fluid to the nozzles 240. Lines 712 illustrate the direction of flushing fluid jetting out of the nozzles 240, demonstrating how in the various depicted embodiments a clean area for video capture is defined to provide clear sideview or clear downview or both.

Figure 13:
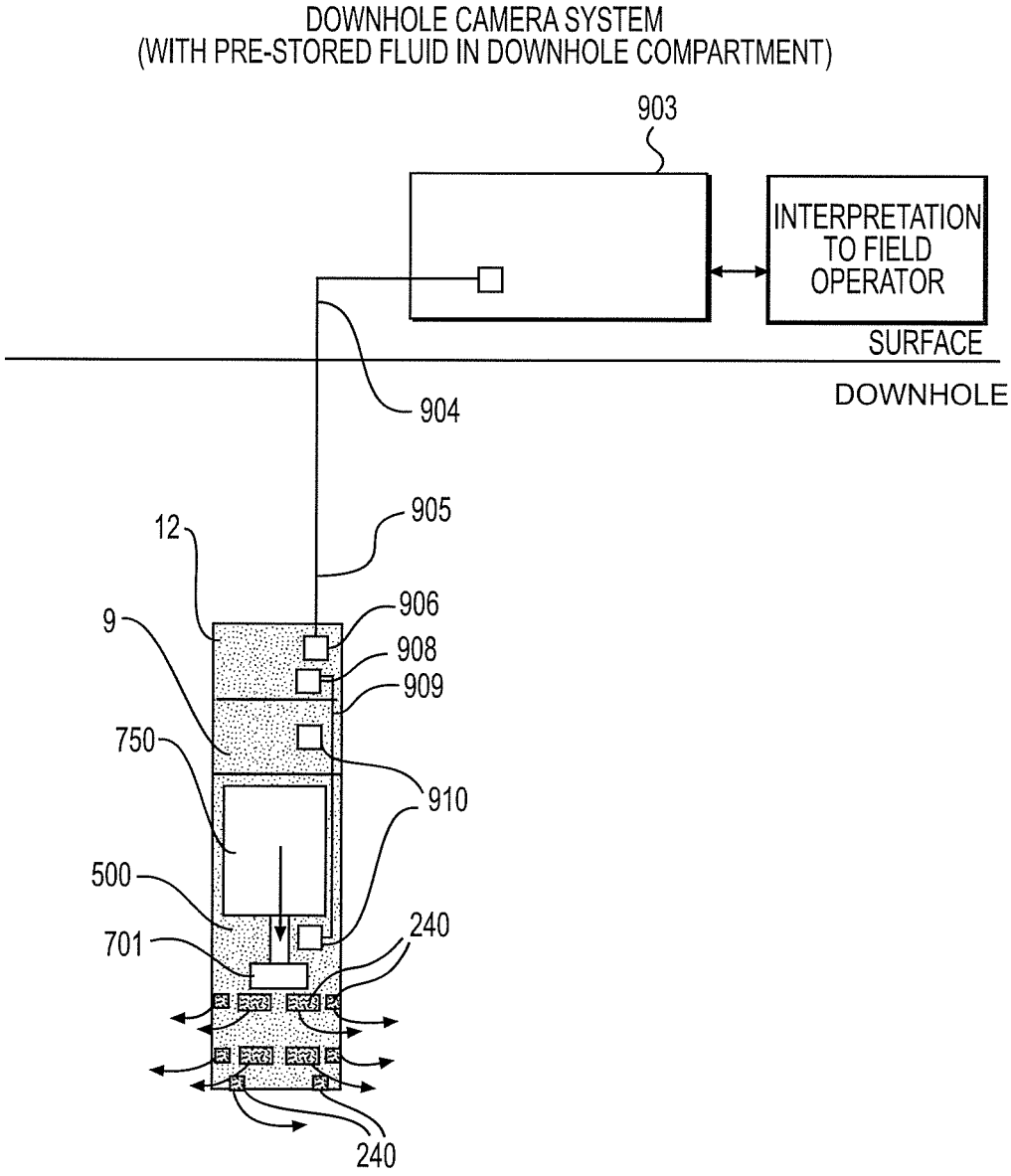
FIG. 13 is a schematic illustration of an embodiment of a Downhole Camera system where a jet-flushing fluid reservoir is integrated into a downhole tool.

FIG. 13 illustrates an alternative embodiment of the jet-flushing system in which the pumping fluid (or a portion of the pumping fluid) may be located downhole. Here, a compartment 750 containing jet-flushing fluid is integrated into the toolstring 12 downhole, and is controlled by the jet-flush controller 701 which includes a motor/pump.

As a person of skill in the art understands based on a review of this disclosure, the nozzles may be sized taking into account a number of factors such as the desire to achieve laminar flow out of the nozzles, and one or more of the volume of jet fluid desired to be flushed in a desired time period, the distance between nozzle and target, the size of the area of the field-of-view. In some embodiments, the nozzle diameter is sized to result in laminar flow and to achieve a desired field-of-view. For example, in some embodiments, the diameter of the nozzle ranges from about 10-20 mm to cover 70-140 mm jet-flush distance. In some embodiments, the desired nozzle diameter may be determined by conducting jet-flushing experiments under downhole conditions.

Figure 16:
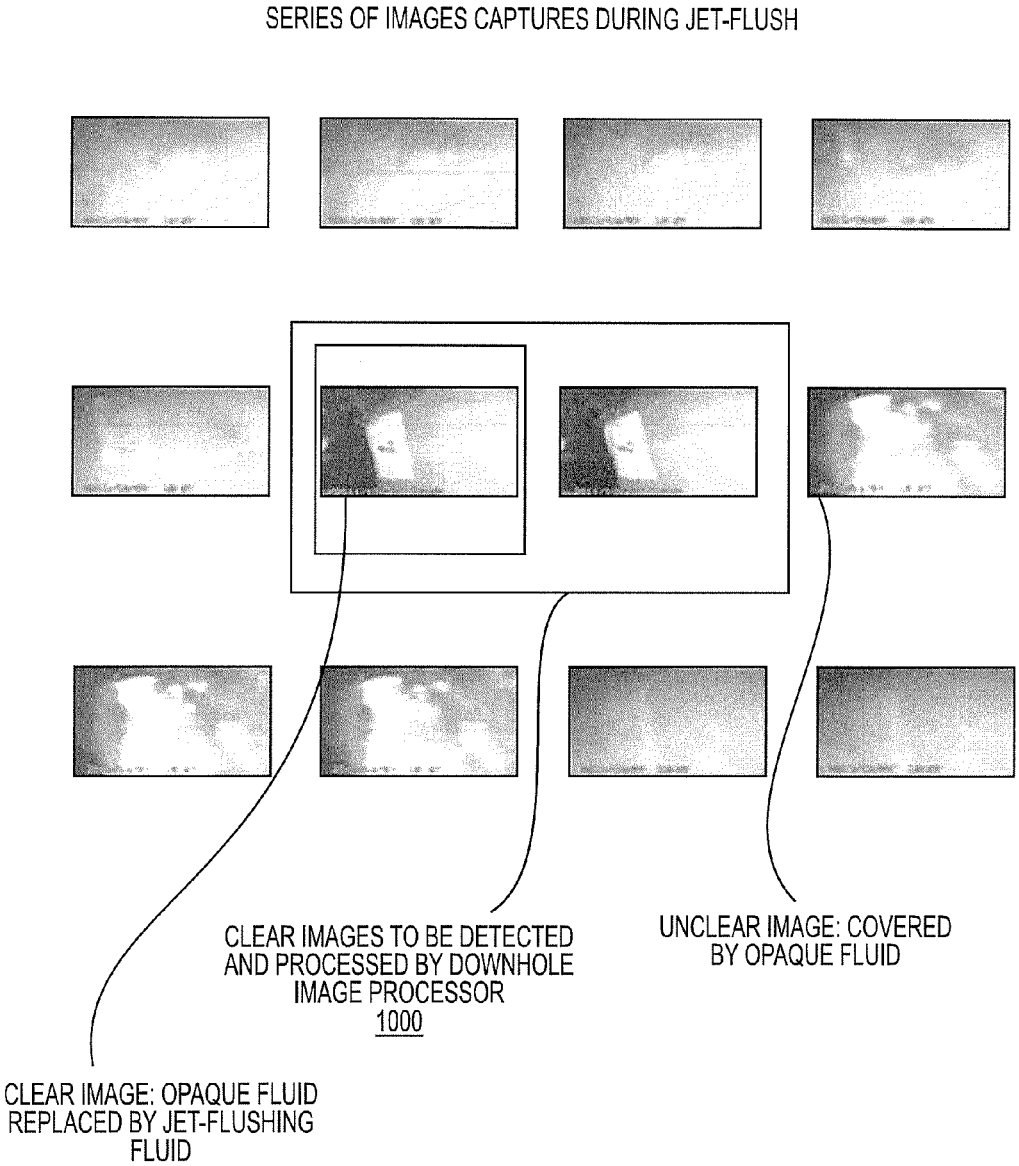
FIG. 16 is a series of images captured using Downhole Camera system and method according to this disclosure, identifying the clear images which are captured when jet-flushing fluid replaces downhole fluid.

"Smart" Downhole Camera systems in accordance with this disclosure may also include a downhole image processor (not shown) for pre-processing images prior to transmission to surface. In some embodiments, the image processor reduces the amount of information captured by the video camera that is transmitted to surface. For example, as shown in FIG. 16, the image processor may be configured to identify a subset of image frames 1000 from the set of image frames captured by the video camera for transmission to the surface. The subset may comprise the image frames which are identified as being the clearest in the set of image frames, or as another example may comprise the image frames that are identified as having a certain minimum desired level of clarity. In some embodiments, the downhole image processor uses an edge-detection algorithm to sort image frames and identify specific frames for transmission to surface. In some embodiments, the clearest images are those taken through opaque fluid, e.g., when the downhole opaque fluid is replaced by jet-flushing fluid and before the opaque fluid returns.

In some embodiments, the systems further include an electronics subsystem for controlling the imaging system (e.g., the video camera), for controlling the jet-flushing system, for processing images captured by the video camera, for controlling the illumination/lighting device or combinations thereof. In some embodiments, where image capture results in a set of captured image frames, the electronics subsystem comprises a photo detector (PD) array (such as but not limited to CMOS imager or CCD) and a processing element (PE) array, for example as described in U.S. Pub. No. 20120076364, "Imaging Methods and Systems for Downhole Fluid Analysis," and Masatoshi Ishikawa et al., "A CMOS Vision Chip with SIMD Processing Element Array for 1 ms Image Processing," IEEE International Solid-State Circuits Conference (ISSCC 1999), Dig. Tech. Papers, pp. 206-207, 1999, both of which are herein incorporated by reference in their entirety. In some embodiments, the PE can be embedded into each PD pixel on the same chip. In some embodiments, the PE array and the PD array can be a separate chip, where the PE array chip and PD array chip are connected using a high-speed inter-chip communication bus (e.g., high-speed serial communication). In this case, each of the PEs has its corresponding PD pixel virtually connected through the high-speed inter-chip communication bus (e.g., high-speed serial communication). The controller/processor may send an instruction (SIMD: single instruction multiple data) to PE array to perform the pixel parallel processing to process the image captured by PD array. Each pixel of the PE has memory to store the pixel information captured by corresponding PD pixel and can also be used as volatile memory to store intermediate computation data, initialization or coefficient data and so on. Each PE also has access to their adjacent neighbor PE (up, down, right, left) memory. Each PE also has the arithmetic logic unit (ALU) to perform arithmetic calculation. The controller/processor can be programmed to substantially synchronize image capture with jet flushing, and to apply a post-image processing algorithm to reduce the number of captured image frames sent to surface, or combinations thereof. In further embodiments, the algorithm is an edge-map algorithm that results in identifying a subset of the captured image frames which are clearer than other image frames in the set of captured image frames.

In some embodiments, the Downhole Camera systems and methods do not require replacing the whole well fluid but only replacing fluid at a limited area nearby the fluid exit/nozzle (for example, clear fluid may be pumped from surface at high pressure to create jet-flushing at downhole nozzle exit, this clear fluid jet-flushing will do one or more of: push away opaque fluid between the target and downhole camera windows, wash target surface, wash optical window surface). Hence the downhole fluid in that limited area (e.g., target surface, space between target and camera and camera surface) can be cleaned in relatively short time and using a relatively small amount of clean fluid volume.

Figure 11:
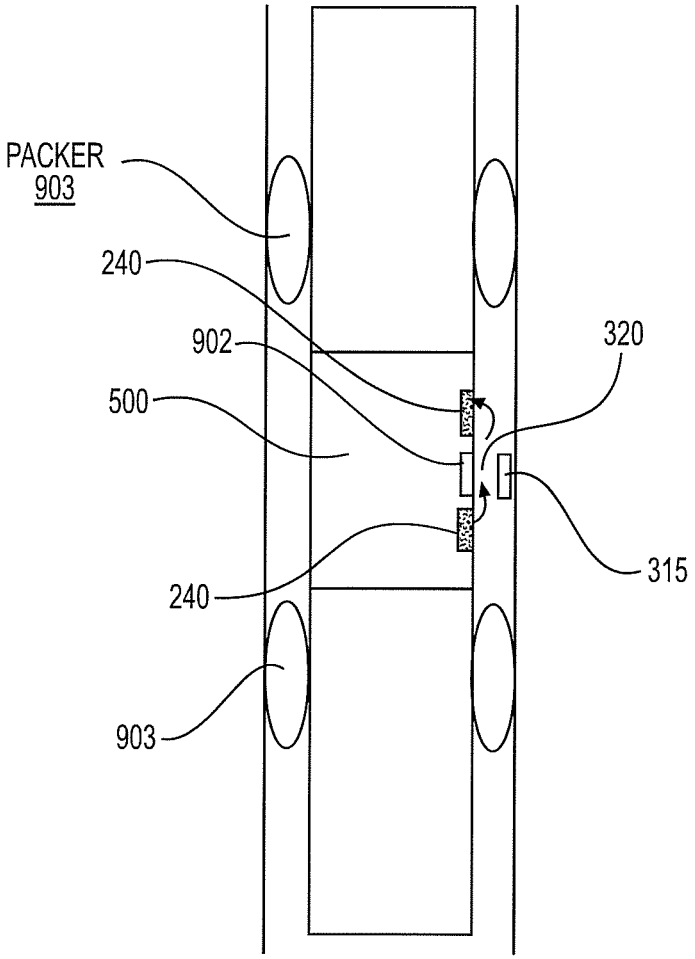
FIG. 11 is a schematic illustration of the jet-flushing system embodiment of FIG. 6, including the addition of packers to isolate an area to be cleaned with flushing fluid.
Figure 14:
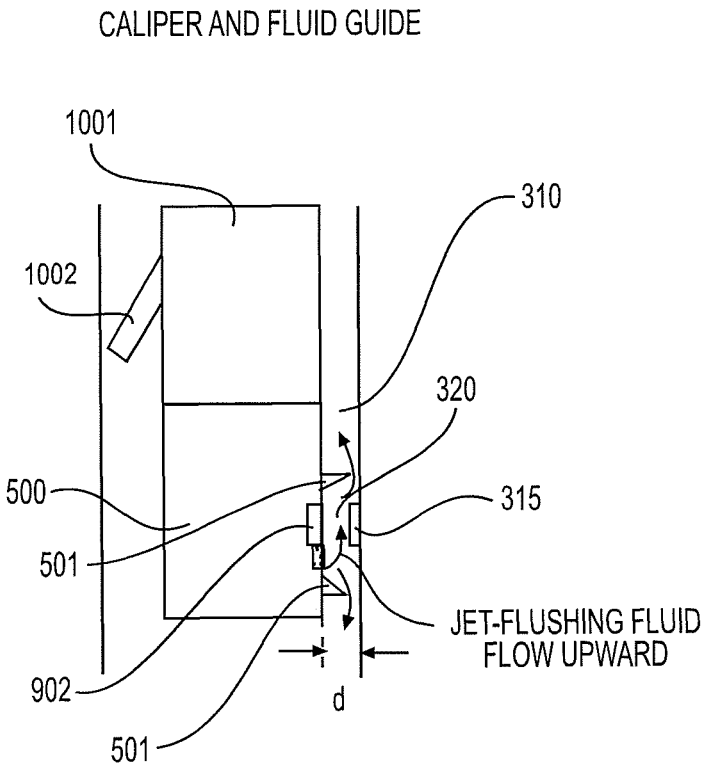
FIG. 14 is a schematic illustration of means for fine-tuning the positioning of a Downhole Camera system, which may assist in reducing the distance between the camera and the target and therefore also in reducing the target area for cleaning by jet-flushing.
Figure 15:
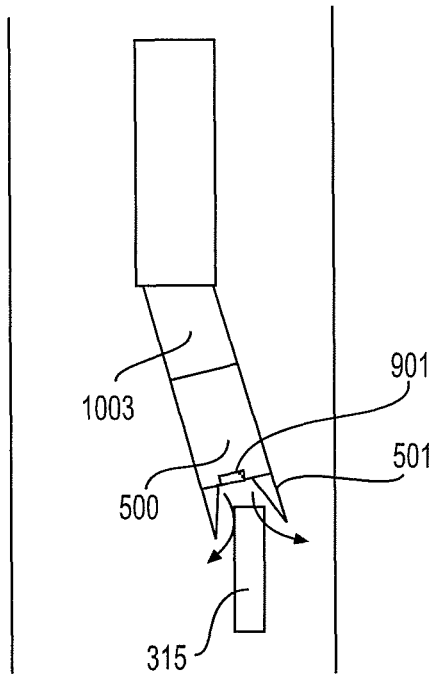
FIG. 15 is a schematic illustration of another embodiment of means for fine-tuning the positioning of a Downhole Camera system, which may assist in reducing the distance between the camera and the target and therefore also reducing the target area for cleaning by jet-flushing.

FIGS. 11, 14 and 15 illustrate additional embodiments in which the (smart) Downhole Camera systems according to this disclosure may be implemented into drilling operations, and which are compatible with reducing the area for jet-flushing. In one embodiment, as shown in FIG. 11, packers 903 may be used to enable isolation of an area to be cleaned by jet-flushing fluid. According to FIG. 14, a caliper tool 1001 comprising calipers 1002 may be used to position the camera closer to the target, reducing the distance between the camera and target and thereby minimizing the target area for jet-flushing. And, according to FIG. 15, the camera module may be integrated onto a bend-sub 1003 to provide additional flexibility regarding position of the camera module downhole, thereby also facilitating positioning the camera nearer the target and reducing the area for which jet-flushing is desirable.

In methods according to this disclosure, the smart Downhole Camera methods may involve capturing a set of image frames downhole using a camera (e.g., a video camera) having a 360 degree optical field-of-view and substantially simultaneously projecting a flushing fluid downhole using a jet-flushing system, such as illustrated in FIGS. 4-10, configured to project flushing fluid along all azimuths within the borehole, for example within the optical field-of-view. In such embodiments, therefore, at least for a portion of the time the video camera is taking video, the jet-flushing system is activated to temporarily displace the existing downhole fluid with a jet-flushing fluid such as clear water, along all azimuths thereby pushing debris out of the optical field-of-view. In some embodiments, the video camera is a high-speed video camera, for example which can shoot at about 100-1000 frames/second. In such embodiments, the amount of flushing fluid needed is relatively small, such as an amount sufficient to push away the existing downhole fluid in the optical field-of-view and for substantially the length of time during which video is being captured, or for a subset of that time as desired.

A person of skill reading this disclosure would be able to determine an appropriate time duration for video capture and flushing, as well as determine the volume of flushing fluid desired for use. The duration of flushing for example may generally correspond to the diameter of the nozzle, the size of the optical field-of-view, and the type of camera being used.

The smart Downhole Camera methods may also involve pre-processing the captured video prior to transmission to surface. For example, the captured video can be processed to identify the clearest frames, so that only those clearest frames are transmitted to surface. The clearest frames may be identified, for example, by using an edge-mapping program to pick out the frames with the sharpest edges relative to other frames, or with a minimum level of sharp edges, for transmission to surface.

The smart Downhole Camera methods may also involve securing packers 903 between the tool chassis 601, 602 and the borehole wall to isolate the area under investigation and into which jet-flushing fluid is projected.

Figure 17:
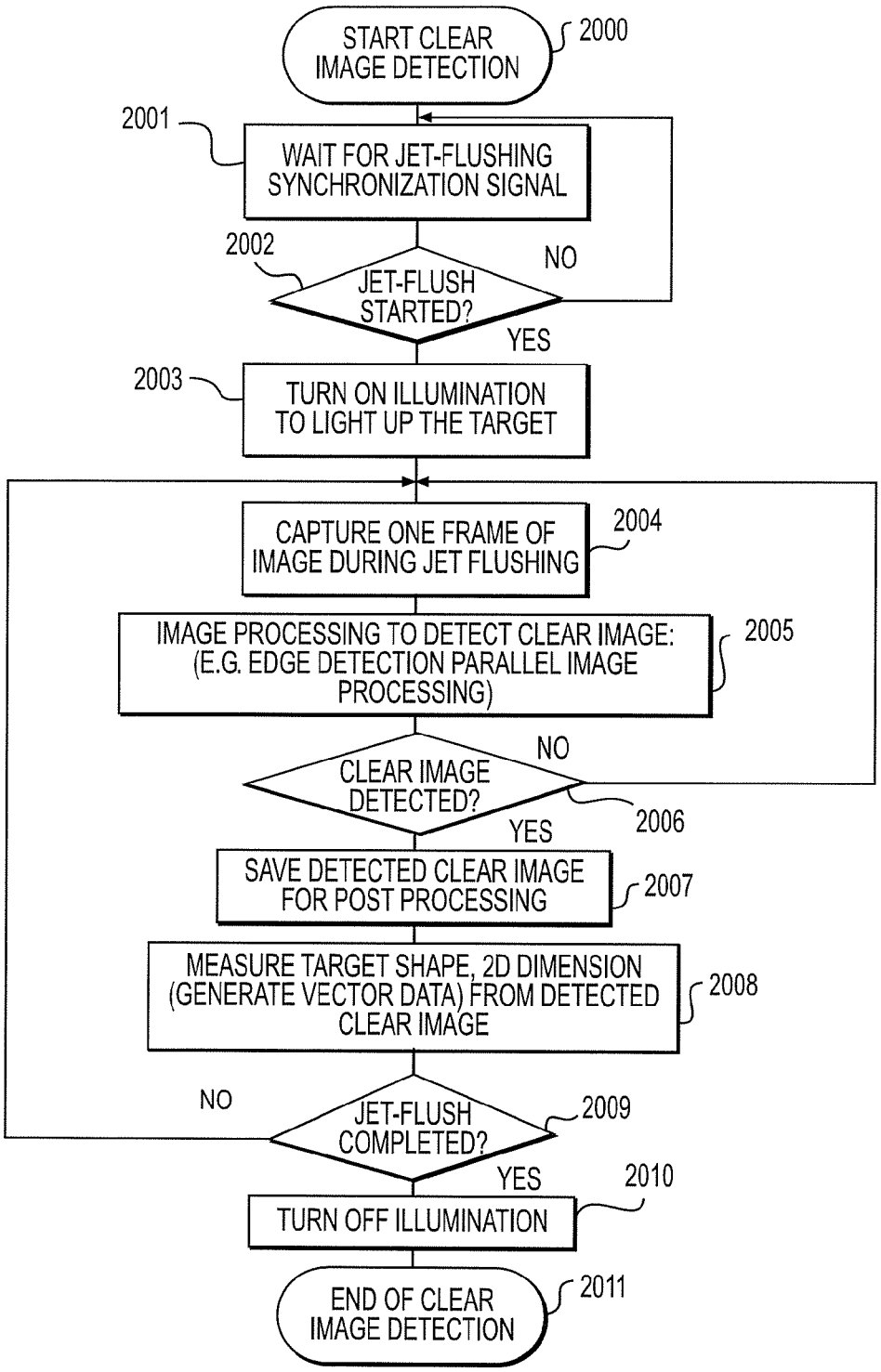
FIG. 17 is a process flow diagram of an embodiment of a clear image capture method according to this disclosure.
Figure 18:
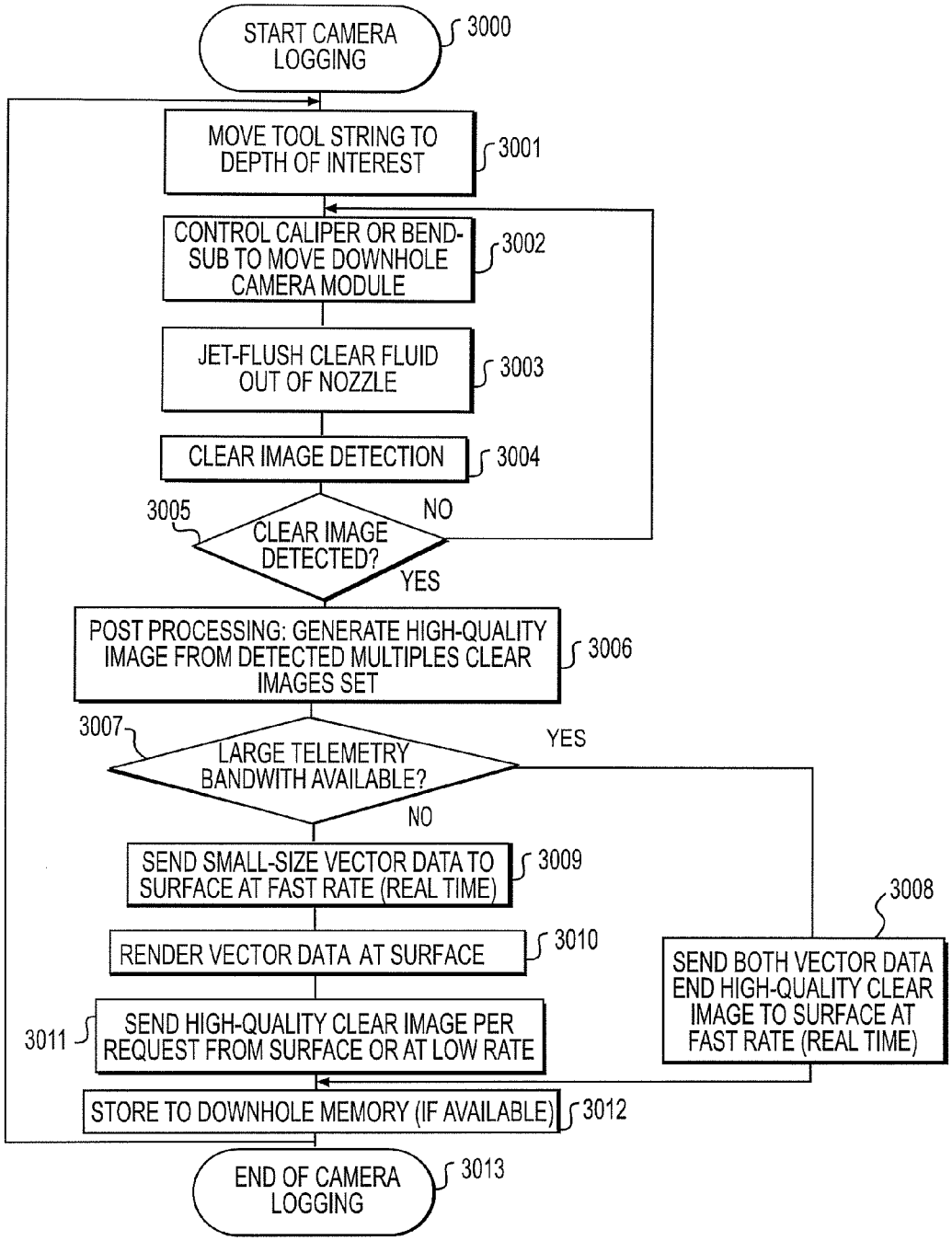
FIG. 18 is a process flow diagram of an embodiment of a clear image capture method such as shown in FIG. 17 implemented in an oilfield tool string process.

FIG. 17 is a process flow diagram illustrating an embodiment of a "clear image detection" method in accordance with this disclosure. FIG. 18 is a process flow diagram illustrating an embodiment of how the "clear image detection" method, such as shown in FIG. 17, is implemented using a wellsite system such as shown in FIG. 1A.

More specifically, in accordance with the embodiment of FIG. 17, a "clear image detection" procedure begins at block 2000. If a jet-flushing synchronization signal is received at block 2001 indicating that jet-flushing has started 2002, the target is then illuminated at block 2003 and image capture is initiated with a goal of capturing at least one clear image during jet-flushing 2004. Image processing occurs at block 2005 to determine whether or not a clear image has been captured 2006, for example using edge detection parallel image processing. If a clear image has not been detected, the process loops back to block 2004 to capture an additional image. If a clear image has been captured, the image is saved at block 2007, for example for post-processing and can be used as a basis of measuring target shape, 2D dimension (e.g., generate vector data) at block 2008. If jet-flushing is not yet complete at block 2009, the process again loops back to block 2004 to capture another image. If jet flushing is complete 2009, illumination is turned off at block 2010 and the "clear image detection" method ends at block 2011.

FIG. 18 illustrates an embodiment of how the clear image detection method 2000 may be integrated and used at a wellsite as part of a logging process 3000. The tool string is moved to a desired depth of interest 3001. "Fine-tuning" of the position of the camera module near a target of interest may be accomplished by use of calipers and/or bend-sub 3002. Once positioned, jet-flushing begins 3003 followed by clear image detection 3004, for example as described in connection with FIG. 17. If a clear image is not detected 3005, the process is repeated from block 3002 where the position of the camera module is further fine-tuned and another jet-flushing sequence can occur. If a clear image is detected 3005, the captured data is post-processed 3006, for example to generate a single high-quality image from a set of multiple clear images. The data is then transmitted to surface. If a large telemetry bandwidth is available 3007, both vector data and the high-quality clear image may be sent to surface at a fast rate 3008, for example real-time. If a large telemetry bandwidth is not available 3007, small-size vector data may be sent to the surface at a fast rate, for example real time 3009, and the vector data may be rendered at surface 3010 followed by sending a high-quality clear image as requested from surface or at a low rate 3011. If available, the data may be stored in a downhole memory 3012 whereupon the process may start anew by moving the drill string or coiled tubing to another position 3001 or the process may come to an end 3013.

Although a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

Finally, although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. A system for capturing images of a target downhole, comprising:

a. a camera system having an optical field-of-view configurable for sideview, downview for capturing data comprising a set of captured image frames, or both, wherein the camera system comprises at least two imaging systems to determine respective two-dimensional positioning data included in the captured data;

b. fine-tuning means for locating the camera system nearby the target chosen from a downhole caliper mechanism and a bend-sub attached to the camera system;

c. a jet-flushing system for replacing downhole fluid with jet-flushing fluid to establish a clean optical path in the optical field-of-view between the camera and a downhole target surface;

d. an illumination system;

e. an image processing system for processing the captured data downhole, wherein the image processing system is configured to combine the respective two-dimensional positioning data to determine three-dimensional positioning data;

f. a communication system for transmitting the captured data, processed data or both, or three-dimensional positioning data to surface in real-time; and g. a surface acquisition system for receiving the transmitted data.

2. A system according to claim 1, wherein the optical field-of-view is a substantially 360 degree optical field-of-view, and the jet-flushing system is configurable to jet-flush fluid downhole along all azimuths simultaneously and in the optical field-of-view.

3. A system according to claim 2, further comprising an optical mirror to provide the substantially 360 degree optical field-of-view.

4. A system according to claim 1, further comprising an electronics subsystem for controlling image capturing by the camera system, for controlling the illumination system, for controlling the jet-flushing system, for processing images captured by the camera system, or combinations thereof.

5. A system according to claim 1, wherein the illumination system, the camera system and the jet-flushing system are synchronizable such that image capture and illumination are activated by jet-flushing.

6. A system according to claim 1, further comprising downhole packers for isolating an area for jet-flushing and to prevent or alleviate fluid outside the area from entering the area.

7. A system according to claim 1, wherein the camera system and the jet-flushing system are integral with oilfield tubing chosen from coiled tubing, wireline toolstring, and logging-while-drilling toolstring.

8. A system according to claim 1, wherein the image processing system comprises an edge-detection algorithm for downhole identification of a subset of captured image frames having a higher spatial frequency content relative to other image frames in the set of captured image frames.

9. A system according to claim 1, wherein the image processing system comprises a pixel parallel image processing architecture comprising a plurality of photo detectors to sense light in the optical field-of-view and a plurality of processing elements, wherein each processing element is associated with a photo detector and each processing element comprises an arithmetical logic unit and an internal memory for processing image data captured by its associated photo detector and four neighboring processing elements.

10. A system according to claim 1, wherein the jet-flushing system comprises: a number of nozzles sufficient to project flushing fluid along all azimuths; a number of nozzle orientation controllers sufficient to control the orientation of each nozzle; a number of valves and valve controllers sufficient to control the duration of fluid flow through each nozzle.

11. A system according to claim 10, wherein the jet-flushing system further comprises a flushing fluid reservoir in fluid communication with each nozzle.

12. A system according to claim 10, wherein at least a portion of the nozzles are configured to project flushing fluid to provide a 360 degree down view, side view or both below a downhole tool.

13. A method, comprising:

a. capturing a set of image frames downhole using a video camera having a substantially 360 degree optical field-of-view; and, b. substantially simultaneously and for at least a portion of the time period during which the images are captured, projecting a flushing fluid downhole along all azimuths within the optical field-of-view using a jet-flushing system, wherein the jet-flushing system comprises: a number of nozzles sufficient to project the flushing fluid along all azimuths; a number of nozzle orientation controllers sufficient to control the orientation of each nozzle; and a number of valves and valve controllers sufficient to control the duration of fluid flow through each nozzle.

14. A method according to claim 13, further comprising: processing the images downhole to reduce the set of image frames prior to transmission to surface.

15. A method according to claim 14, wherein processing the images downhole comprises applying an edge-detection algorithm for identifying a subset of image frames from the captured images that are clearer than other captured images in the set of image frames.

16. A method according to claim 13, wherein the jet-flushing system further comprises a flushing fluid reservoir in fluid communication with each nozzle.

17. A system for capturing images of a target downhole, comprising:

a. a camera system having an optical field-of-view configurable for sideview, downview for capturing data comprising a set of captured image frames, or both, wherein the camera system comprises at least two imaging systems to determine respective two-dimensional positioning data included in the captured data;

b. a jet-flushing system for replacing downhole fluid with jet-flushing fluid to establish a clean optical path in the optical field-of-view between the camera and a downhole target surface;

c. an illumination system;

d. an image processing system for processing the captured data downhole, wherein the image processing system is configured to combine the respective two-dimensional positioning data to determine three-dimensional positioning data;

e. a communication system for transmitting the captured data, processed data or both, or three-dimensional positioning data to surface in real-time;

f. a surface acquisition system for receiving the transmitted data;

g. a main controller;

h. a manipulation controller; and i. a manipulator, wherein the main controller is configured to process the three-dimensional positioning data to produce an externally-applied control input to be applied to the manipulation controller to control the manipulator.

* * * * *